US005222872A

United States Patent [19]

Marian et al.

[11] Patent Number: 5,222,872

[45] Date of Patent: Jun. 29, 1993

[54] CONTROL SYSTEM FOR PISTON PUMPS

[75] Inventors: F. Marian, Herdecke; H. J. Pöting, Witten; R. Schwittek, Sprockhövel, all of Fed. Rep. of Germany

[73] Assignee: Paul Pleiger Maschinenfabrik GmbH & Co. KG, Witten, Fed. Rep. of Germany

[21] Appl. No.: 762,401

[22] Filed: Sep. 19, 1991

[30] Foreign Application Priority Data

Sep. 19, 1990 [DE] Fed. Rep. of Germany ..... 4029718

[51] Int. Cl.[5] ..... F04B 35/02

[52] U.S. Cl. ..... 417/344; 417/317; 417/507; 417/900

[58] Field of Search ..... 417/344, 345, 347, 317, 417/507, 900

[56] References Cited

U.S. PATENT DOCUMENTS 3,198,123 8/1965 Wilkinson et al. ..... 417/345
3,507,347 4/1970 Bennett ..... 417/345
3,994,627 11/1976 Calzolari ..... 417/344

FOREIGN PATENT DOCUMENTS 0419695 4/1991 European Pat. Off. .
224724 12/1942 Switzerland .

*Primary Examiner*—Richard A. Bertsch
*Assistant Examiner*—Charles G. Freay
*Attorney, Agent, or Firm*—Burns, Doane, Swecker & Mathis

[57] ABSTRACT

A double piston pump mechanism includes two pistons operated out-of-phase by respective fluid-actuated cylinders. The pistons suck-in fluid through suction valves and discharge pressurized fluid through pressure valves. The actuation of the cylinders is regulated by two change-over valves which are mechanically connected to respective cylinders. Each change-over valve is actuated when its respective cylinder reaches a fully extended position or a fully retracted position. The change-over valves are connected to a control mechanism which operates to reverse the direction of actuating fluid supplied to the cylinders, the suction valves, and the pressure valves only in response to actuation of both of the change-over valves.

15 Claims, 3 Drawing Sheets

CONTROL SYSTEM FOR PISTON PUMPS

The invention relates to a control system for piston pumps.

Piston pumps of this type and in particular double piston pumps are used for delivering such unusual media as goose quills, bones, sludge with stone chips, and the like. It is known to electronically control the hydraulic actuating cylinders for the pump pistons and the hydraulic regulating cylinders for the suction and pressure valves in their displaced working sequence. An electronic control system is associated with problems or is inadmissible for certain fields of application, for example in a potentially explosive environment.

The object of the invention is to propose a fully hydraulic control system for a double piston pump of the type specified at the beginning, which control system can also be used in a potentially explosive environment.

This object is achieved according to the invention. The arrangement of a pilot valve controlled by the pump piston and of a control device controlled in turn by this pilot valve for the actuating cylinders on the one hand and the regulating cylinders on the other hand results in a fully hydraulic control system which works reliably and in an operationally safe manner in the predetermined cycle, since the control devices only change over when the pilot valve is changed over, in particular mechanically, by the pump piston.

THE DRAWINGS

An exemplary embodiment of the invention is described in more detail below with reference to the drawing, in which:

FIG. 1 shows a circuit diagram of the fully hydraulic control system in a double piston pump, FIG. 2 shows a modified embodiment of the control system, and FIG. 3 shows a longitudinal section through a preferred embodiment of a change-over valve.

DETAILED DESCRIPTION OF A PREFERRED EMBODIMENT OF THE INVENTION

Figure 1:
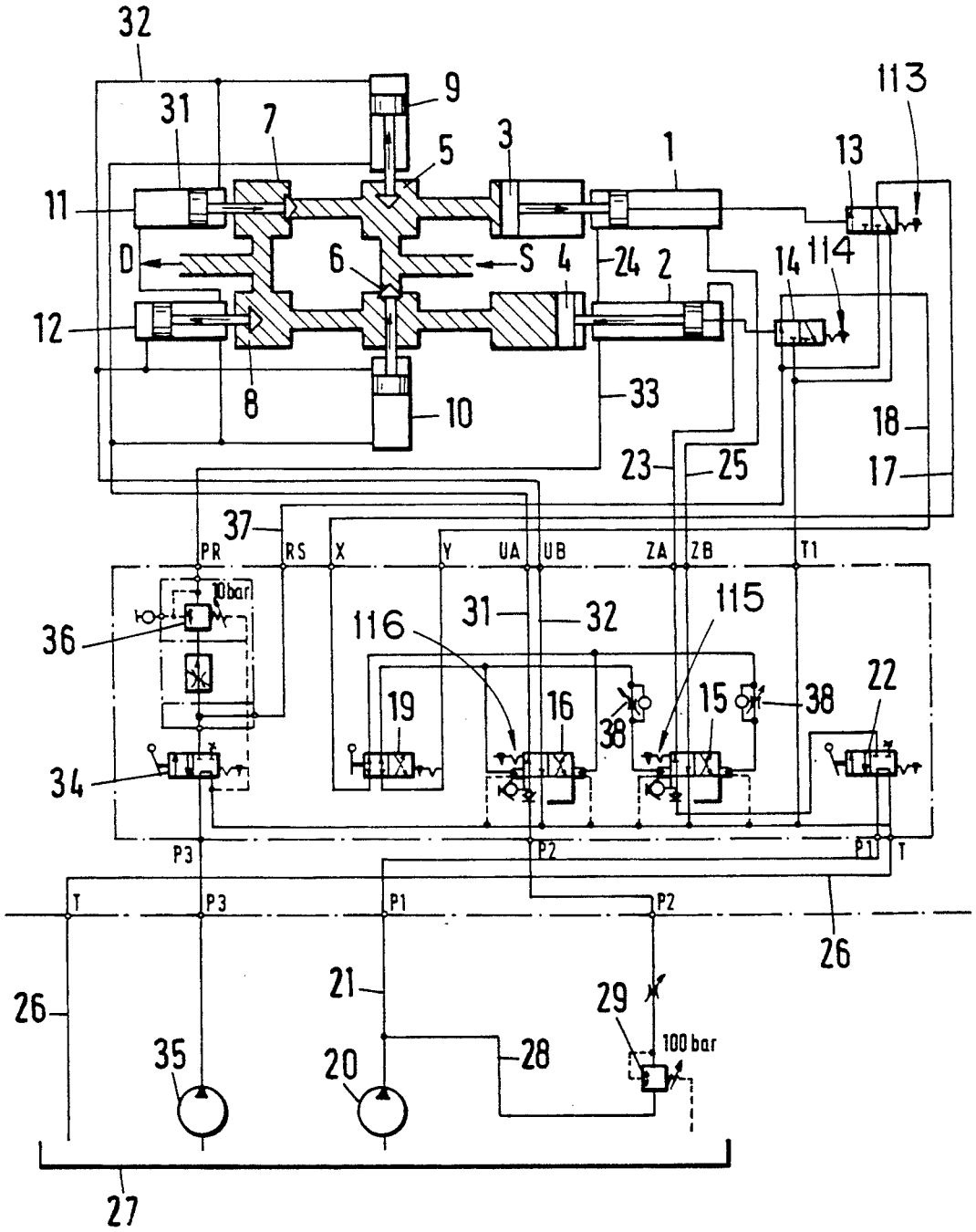
Figure 2:
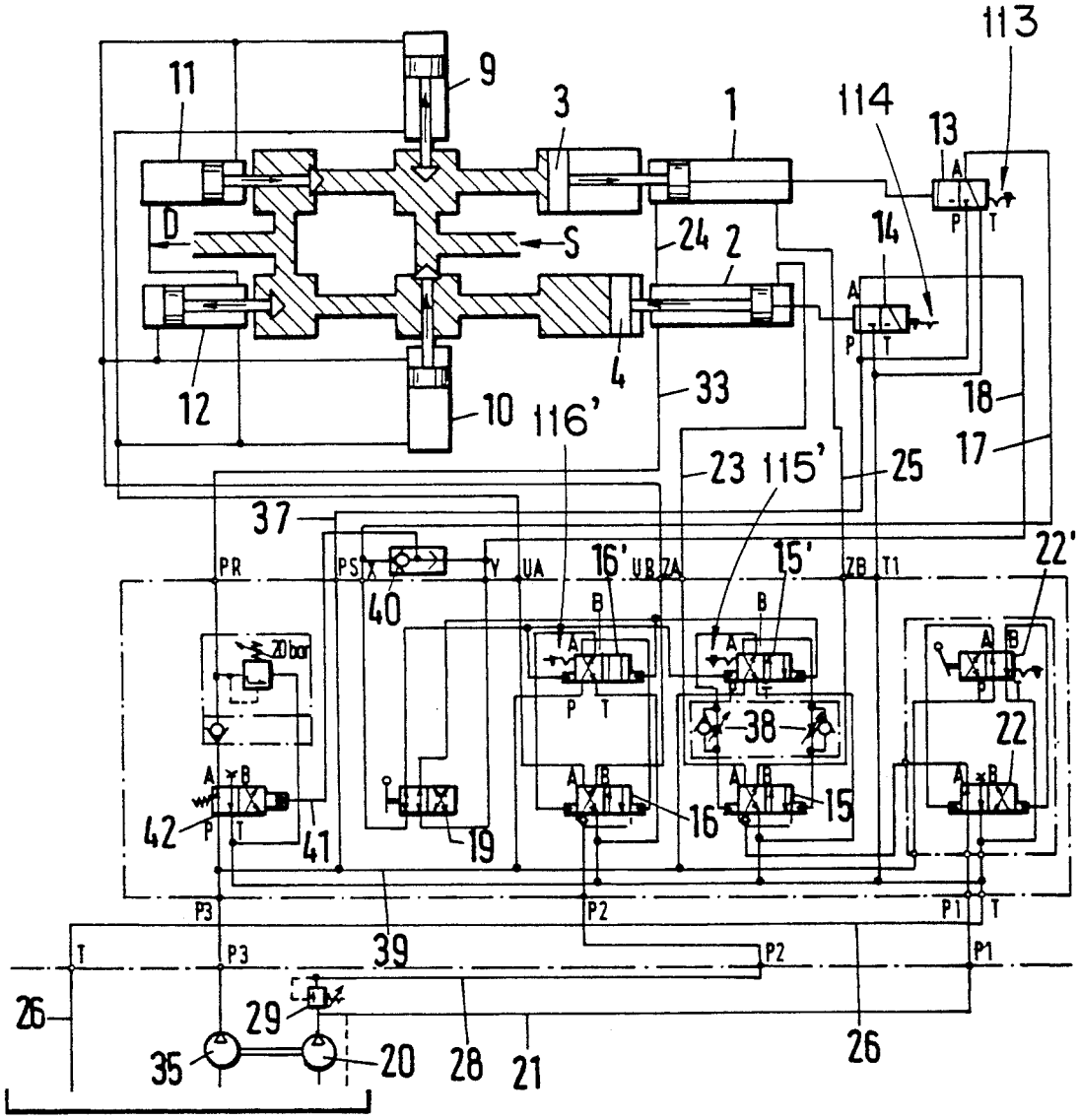

FIG. 1, 1 and 2 designate the actuating cylinders of a double piston pump which in each case drive pump pistons 3 and 4 respectively. A suction valve 5 and a pressure valve 7 are allocated to the piston 3, and a suction valve 6 and a pressure valve 8 are allocated to the piston 4. These suction and pressure valves are each actuated by regulating cylinders 9 to 12. S designates the suction connection and D the pressure connection of the pump.

The two actuating cylinders 1 and 2 are each connected to change-over valves 13 and 14 respectively in such a way that these change-over valves are changed over in the end positions of the allocated pistons 3, 4. Thus the piston of the actuating cylinder, for example via a plunger, can come into mechanical engagement with a control element of the change-over valve in the end positions and can shift this control element, or can be mechanically connected to the latter.

These change-over valves 13, 14 are connected via a pressure-medium line 37 to a feed pump 35 which supplies a constant pressure P3 and they are connected in FIG. 1 to control devices or main control valves 15, 16 in order to change over the latter as a function of the operating position of the change-over valves. A control line 17 leads from the change-over valve 13 and a control line 18 leads from the change-over valve 14 in each case to the two control devices 15 and 16, a valve 19 which can be actuated manually being inserted in these two control lines. Furthermore, the two control devices 15, 16 are connected via pressure-medium lines to a supply pump 20 which supplies the pressure medium required for admitting pressure to the actuating cylinders 1, 2 and the operating cylinders 9 to 12.

The supply pump 20 is responsive to pressure and delivery flow so that it is automatically adjusted to the pressure Pl which is required for the delivery flow in the double piston pump. A pressure-medium line 21 leads from the supply pump 20 to the control device 15 via a manually controllable valve 22. From this control device 15, a line 23 leads to the actuating cylinder 2 on its piston side, whereas on the piston-rod side the actuating cylinder 2 is connected via a line 24 to the piston-rod side of the actuating cylinder 1 so that, when pressure medium is admitted to the actuating cylinder 2, the pressure medium located on the piston-rod side is thrust via the line 24 into the actuating cylinder 1, which thereby performs a stroke in the opposite direction. From the piston side of the actuating cylinder 1, a pressure-medium line 25 leads to the control device 15, through which the pressure medium coming from the supply pump 20 is directed at the pressure Pl as a function of the operating position into the pressure-medium line 23 or 25, the other line in each case serving as return line. A return line 26 leads from the control device 15 to a reservoir 27, in which arrangement, in the operating position shown of the manual valve 22, the pressure-medium line 21 from the supply pump 20 is short-circuited with the return line 26.

The other control device 16 is likewise connected to the return line 26 and it is supplied with pressure medium from the supply pump 20 via a line 28, this line 28 branching off from a pressure line 21, and the pressure in this line 28 being reduced by a pressure-reducing valve 29 to a certain value P2. From the control device 16, a line 31 leads to the piston side of the regulating cylinders 10 and 11 as well as to the piston-rod side of the regulating cylinders 9 and 12. A line 32 starting at the control device 16 leads to the piston-rod side of the regulating cylinders 10 and 11 and to the piston side of the regulating cylinders 9 and 12.

From the piston-rod side of the actuating cylinder 2, a line 33 leads via a manually adjustable valve 34 to the feed pump 35, which delivers pressure medium which is reduced via a pressure-reducing valve 36 to, for example, 10 bar and serves to compensate for any leakage losses and to assist the suction stroke at the actuating cylinders 1 and 2. In the position shown in FIG. 1 of the manual valve 34, the pressure-medium flow from the feed pump 35 is short-circuited with the return line 26.

The control system according to FIG. 1 works as follows. In order to put the double piston pump into operation, first of all the manual valves 22 and 34 are shifted from the position shown into the other operating position. The actuating cylinders 1 and 2, via the manual valve 22 and the control device 15, are then supplied with pressure medium from the supply pump 20 up to the maximum set pressure or with the pressure which the medium to be pumped exactly needs on account of its consistency, delivery height, piping resistance, etc., the supply pump 20 being automatically set to the required pressure. While the actuating cylinder 2, for example, performs a pressure stroke, as indicated by an arrow, the pressure medium displaced on the piston-rod side is thrust to the piston-rod side of the actuating cylinder 1, which thus performs a suction stroke, which is assisted by the pressure supplied by the feed pump 35.

At the same time, pressure is admitted to the regulating cylinders 9 and 10 of the suction valves 5 and 6 via the control device 16 in such a way that the suction valve 5 is open and the suction valve 6 is closed, while via the regulating cylinders 11 and 12 the pressure valve 7 is closed and the pressure valve 8 is open. By the pressure stroke of the actuating cylinder 2, the medium to be pumped is therefore thrust by the pump piston 4 into the pressure line D, while the pump piston 3 draws in medium via the suction connection S.

If the actuating cylinders 1 and 2 have reached their end position, the change-over valves 13 and 14 are changed over, and they in turn, by means of the pressure-medium flow at a constant value P3 supplied from the feed pump 35 via the line 37, change over the control devices 15 and 16 so that the actuating cylinders 1 and 2 perform the reversed strokes and the suction and pressure valves are opened and closed in a reversed manner.

Owing to the fact that the change-over valves 13, 14 are changed over mechanically by the pistons of the actuating cylinders 1, 2 in their end positions, the two piston pumps are at the same time locked in such a way that a new working stroke can be initiated only when the preceding stroke movement is also actually complete. Due to this locking, the pump remains in the cycle and does not lose the timed sequence.

The two control devices or main control valves 15 and 16 are provided with catch devices 115–116 respectively, for the operating positions, the arrested operating position being retained until a clear change-over is effected. If one of the actuating cylinders 1 and 2 should reach its end position before the other and thus change over the allocated change-over valve while the other change-over valve is still in the previous operating position, the two control devices 15 and 16 receive operating pressure on both sides via the two control lines 17 and 18 so that there is no clear operating command. The control devices 15 and 16 therefore remain in the previous arrested operating position. Only when the other actuating cylinder has reached its end position and changes over the allocated change-over valve does a clear operating command follow at the control devices 15 and 16, which then change over accordingly.

In order to ensure that the regulating cylinders 9 to 12 actuating the suction and pressure valves have performed their respective strokes before the actuating cylinders 1 and 2 start in the opposite direction, a restricting or flow-regulating valve 38 is in each case inserted in the control lines 17 and 18 leading to the control device 15, by means of which restricting or flow-regulating valve 38 the change-over of the control device 15 is slightly delayed relative to the change-over of the control device 16. This ensures trouble-free pump operation of the double piston pump. If these change-over relationships were not adhered to, some of the medium to be pumped could be thrust back into the suction line S, which would result in a considerable reduction in efficiency.

The pressure-medium flow can be interrupted by means of the manual valve 34 in order to compensate for leakage losses and to assist the suction stroke. The manual valve 22 serves to start and stop the double piston pump.

The direction of movement of the actuating cylinders 1 and 2 and of the regulating cylinders 9–12 can be reversed by the manual valve 19. This is of importance in particular for inspections, repairs and the like.

By the branching-off of a set partial flow via the line 28, which partial flow is supplied from the supply pump 20, identical change-over times are obtained for the suction and pressure valves 5, 6 and 7, 8 even in the event of different speeds of the actuating cylinders 1 and 2 or fluctuating pressure in the pressure line 21. By means of the control system described, an installation having smoothly operated valves is obtained and no knocks occur in the pump unit.

The control system described can be advantageously used not only for double piston pumps but also for simple piston pumps, the piston of the actuating cylinder of this individual pump mechanically changing over the change-over valve so that the control devices for reversing the admission of pressure to the piston and for reversing the suction and pressure valves change over with certainty only when the pump piston has reached its end position.

FIG. 2 shows a modified embodiment of the control system, the same reference numerals as in FIG. 1 being used for identical or corresponding components.

FIG. 2 shows the control system in an operating state in which the actuating cylinders 1 and 2 are to start in the direction indicated by arrows, whereas the allocated change-over and control valves are still in the preceding operating position and have to be changed over for the direction (indicated by arrows) in which pressure is admitted to the actuating cylinders.

In FIG. 2, compared with the control system according to FIG. 1, pilot valves 15' and 16' are provided which are changed over by the change-over valves 13 and 14 via the control lines 17 and 18, these pilot valves 15' and 16', via a pressure-medium line 39 supplied from the feed pump 35, being supplied with a control pressure which is applied by the pilot valves 15' and 16' to the main control valves 15 and 16 in order to change over the latter so that, from these main control valves 15 and 16, the actuating cylinders 1, 2 and the regulating cylinders 9 to 12 are acted upon by pressure medium in the manner described in connection with FIG. 1 or are connected to the return line.

In the exemplary embodiment in FIG. 2, the manual valve 22' for starting and stopping the double piston pump, which manual valve 22' - as schematically indicated - is provided with catch devices for the two operating positions, is designed as a pilot valve which is supplied with constant pressure from the feed pump 35 via the pressure-medium line 39 and, with this pressure, changes over a main valve 22 as a function of the manually shifted operating position, via which main valve 22 the main control valves 15 and 16 are supplied with pressure medium from the pump 20 and are connected to the return line 26, as is also the case according to FIG. 1. In the operating position according to FIG. 2, the pressure of the feed pump 35 is applied via the manual valve 22' to the left-hand side of the main valve 22, which transmits the pressure of the pump 20 to the main control valve 15, which, in the position shown, admits pressure medium to the actuating cylinder 1 via the line 25, while the actuating cylinder 2 is connected to the return line 26 via the line 23 and the main control valve 15. The main control valve 16 for the regulating cylinders 9 to 12 is supplied with reduced pressure directly from the pump 20 via the line 28, this pressure, designated by P2 being applied in the operating position shown to the piston side of the regulating cylinders 9 and 12 as well as to the piston-rod side of the regulating cylinder 11, while the corresponding regulating pistons are provided with arrows which point in the subsequent direction of movement after the main control valve 16 is changed over into the other operating position by the pilot valve 16', the pilot valve 16' in turn being changed over by the change-over valves 13 and 14 via the control lines 17 and 18 in which the pressure (designated by P3) of the feed pump 35 is applied via the line 37, which branches off from the line 39. In other words, the change-over valves 13 and 14 still have to be changed over from the operating position shown into the other operating position by the mechanical coupling with the pistons 3 and 4 so that the pistons 3 and 4 can perform the stroke indicated by arrows.

As in the exemplary embodiment in FIG. 1, the change-over valves 13 and 14 are provided with catch devices 113,114, respectively, for the two operating positions, as schematically indicated. Furthermore, in the exemplary embodiment according to FIG. 2, the pilot valves 15' and 16' are provided with catch devices 115',116', respectively in order to hold the relevant operating position until a clear change-over command comes from the change-over valves 13 and 14 as a function of the end positions of the pistons 3 and 4.

So that the admission of pressure to the actuating cylinders 1 and 2 is slightly delayed relative to the admission of pressure to the regulating cylinders 9 to 12, in order to ensure that the allocated valves are changed over before a new cycle of strokes is initiated at the actuating cylinders, restrictor points 38 are arranged between main control valve 15 and pilot valve 15' in the two control lines, via which restrictor points 38 the pressure of the feed pump 35 is applied by the pilot valve 15' to the main control valve 15 in order to change over the latter In the operating position according to FIG. 2, the pressure of the feed pump 35 is applied to the left-hand side of the main control valve 15, while the opposite side of the main control valve 15 is connected to the return line 26 via the allocated restrictor point 38 and the pilot valve 15'.

Arranged between the two control lines 17 and 18 is a shuttle valve 40 which applies the pressure of the line 17 or 18 just carrying pressure to a valve 42 via a line 41 in order to change over this valve 42. In the operating position shown, the pressure P3 of the feed pump 35 is applied in the control line 18 via the change-over valve 14, while the control line 17 is connected to the return line 26 so that the valve 42 is in an operating position in which no pressure from the feed pump 35 is applied to the line 33. After the change-over valves 13 and 14 are changed over in the allocated end positions of the pistons 3 and 4, the control line 17 carries the pressure P3, while the line 18 is connected to the return. Here, a change-over operation is performed at the shuttle valve 40, by means of which change-over operation the valve 42 is operated in such a way that the pressure of the feed pump 35 is only then applied to the actuating cylinders 1 and 2 via this valve 42 in order to assist the end suction position of the relevant piston. The arrangement of pilot valves 15', 16' and 22' for operating the allocated main valves 15, 16, 22 serves in particular to control larger quantities of pressure medium at the main valves by means of a lower quantity of pressure medium at the pilot valves, in which case a constant pressure can in addition be applied to the pilot valves.

Figure 3:
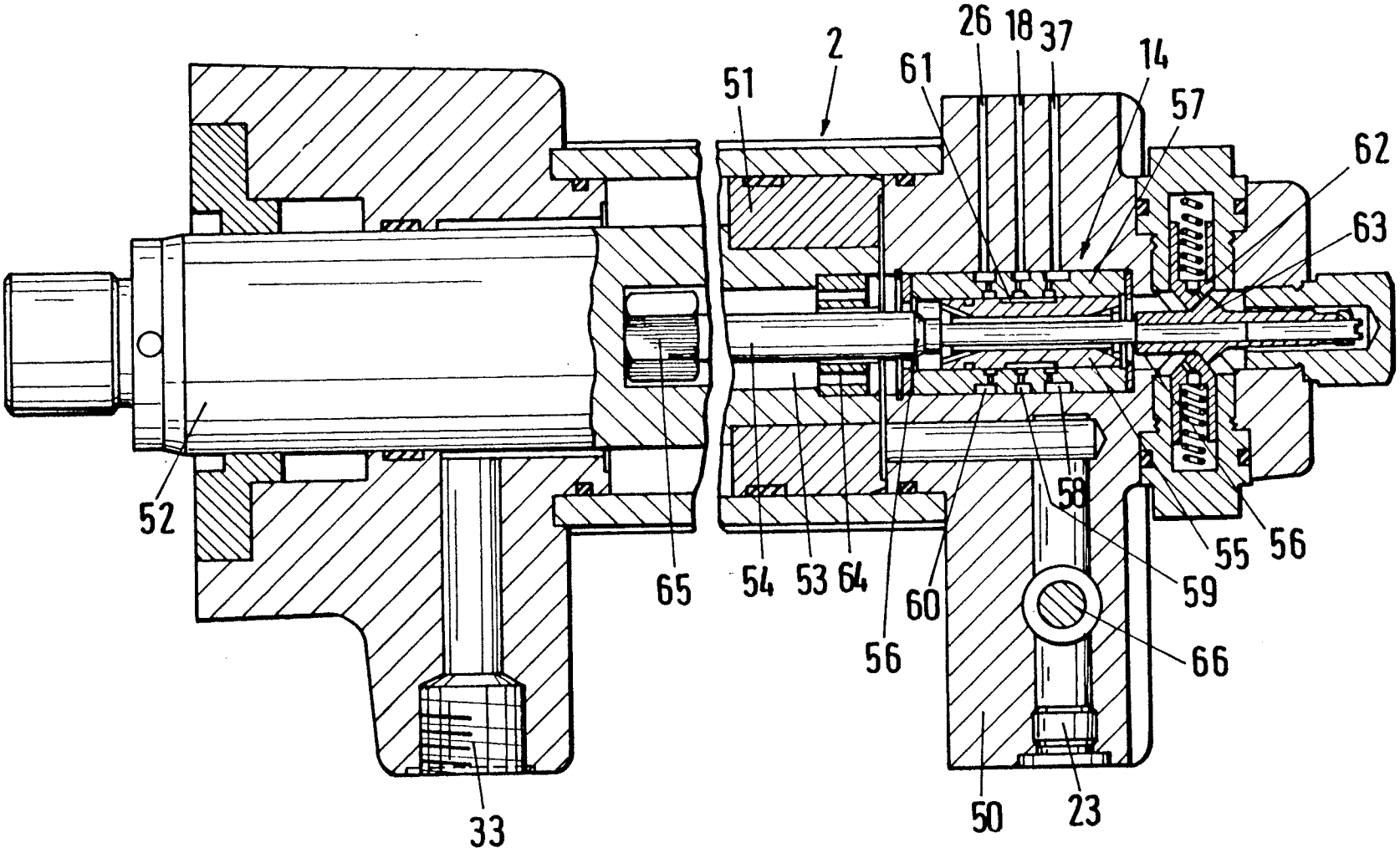

FIG. 3 shows a preferred embodiment for a change-over valve 13 or 14, the same reference numerals as in FIG. 1 in connection with the actuating cylinder 2 being used for identical or corresponding components.

In the embodiment according to FIG. 3, the change-over valve 14 is integrated in a cap 50 of the actuating cylinder 2, the piston 51 of which is firmly connected via the piston rod 52 to the pump piston 4 (not shown in FIG. 3). Along its axis, the piston rod 52 is provided with a blind bore 53, the length of which corresponds approximately to the stroke length of the piston 51 and which serves to accommodate an operating rod 54. In the area of the cylinder cap 50, this operating rod 54 is surrounded by a pilot sleeve 55 which is displaceable relative to the operating rod 54 and can be adjusted by the latter via annular shoulders 56 relative to a control socket 57. On the outer periphery, the control socket 57 is provided with annular grooves 58, 59, 60 which are arranged at a distance from one another and are connected via radial bores to allocated annular grooves on the inner periphery of the control socket. Formed on the outer periphery of the pilot sleeve 55 is a widened annular groove 61 which, in the operating position shown, connects the two annular grooves 58 and 59 to one another, whereas in the other operating position the annular grooves 59 and 60 are connected to one another. The annular grooves 58, 59 and 60 are connected to the allocated lines 37, 18 and 26 in FIG. 1 so that, in the operating position reproduced in FIG. 1 and FIG. 3, the lines 18 and 37 are connected to one another, while the line 26 is shut off at the pilot valve 14 by the pilot sleeve 55.

If, in this operating position, pressure is supplied via the line 23, the piston 51 moves to the left, while the operating rod 54 is held in its position by spring-loaded catches 62 which bear with their beveled engagement end against a projection 63 which is formed on the operating rod 54 and likewise has beveled flanks. Toward the end of the stroke movement of the piston rod 52 to the left in FIG. 3, the operating rod 54 is moved to the left by a driving ring 64 of the piston rod 52, a driving nut 65 fastened to the end of the operating rod 54 coming to bear against the driving ring 64 fastened to the piston rod. The operating rod 54 is thereby moved to the left over the catches at 62, 63 until the right-hand shoulder 56 comes to bear against the pilot sleeve 55 and displaces the latter to the left so that the lines 18 and 26 are connected via the annular groove 61 of the pilot sleeve, while the line 37 is shut off. This corresponds to the second position, reproduced in FIG. 1, of the pilot valve 14.

In this new operating position, the operating rod 54 together with pilot sleeve 55 is held by the catches at 62, 63 until the piston rod 52, during the return stroke into the position shown in FIG. 3, comes to bear against the driving nut 65 from the left and thereby displaces the operating rod 54 into the catch position shown, the left-hand annular shoulder 56 at the operating rod 54 displacing the pilot sleeve 55 into the position shown.

According to a further design, the control device 15 can be integrated into the housing of the actuating cylinder 2 according to FIG. 3 for example by a control slide valve which runs transversely to the line bore 23 being inserted into the cylinder cap 50 at 66, which control slide valve, as indicated in FIG. 1, is acted upon on opposite sides by the pressure of the lines 17 and 18 and thereby controls the admission of pressure to the lines 23 and 25 in accordance with FIG. 1.

We claim:

1. A pumping apparatus for delivering a flowable medium, comprising:

a double piston pump mechanism including:

a first piston, a first suction valve movable between open and closed positions AND communicating a source of said flowable medium with said first piston when in its open position, a first pressure valve movable between open and closed positions and communicating said first piston with an outlet for said flowable medium when its open position, a first fluid-actuated, piston-displacing cylinder for reciprocating said first piston between retracted and extended positions, such that said first piston draws-in flowable medium during displacement toward its retracted position nd discharges the drawn-in flowable medium during displacement toward its extended position, a second piston, a second suction valve movable between open and closed positions and communicating said source of said flowable medium with said second piston when in its open position, a second pressure valve movable between open and closed positions and communicating said second piston with said outlet when in its open position, a second fluid-actuated, piston-displacing cylinder for reciprocating said second piston between retracted and extended positions, such that said second piston draws-in flowable medium during displacement toward its retracted position and discharges the drawn-in flowable material during displacement toward its extended position, said second piston-displacing cylinder being operated 180 degrees out-of-phase relative to said first piston-displacing cylinder, fluid-actuated, valve-displacing cylinders for displacing said suction and pressure valves between their respective open and closed positions cut that said first and second suction valves are operated 180 degrees out-of-phase, and said first and second pressure valves re operated 180 degrees out-of-phase, and pumping means for supplying pressurized actuating fluid to said first and second piston-displacing cylinders, and to said valve-displacing cylinders in either of two directions; and means for regulating the actuation of said first and second piston-displacing cylinders, including:

a first change-over valve mechanically connected to said first piston-displacing cylinder for being actuated in response to said first piston-displacing cylinder reaching either of its fully extended and fully retracted positions, a second change-over valve mechanically connected to said second piston-displacing cylinder for being actuated in response to said second piston-displacing cylinder reaching either of its fully extended and fully retracted positions, control means operably connected to said first and second change-over valves for reversing the direction of actuating fluid to said first and second piston-displacing cylinders, and to said first and second suction valve-displacing cylinders, and to said first and second pressure valve-displacing cylinders only in response to actuation of both of said first and second change-over valves.

2. A pumping apparatus according to claim 1, wherein said valve displacing cylinders comprise separate cylinders of said first suction valve, said second suction valve, said first pressure valve, and said second pressure valve, respectively.

3. A pumping apparatus according to claim 1, wherein a pressure reducing valve is disposed in a conduit connecting said pumping means with said valve-displacing cylinders.

4. A pump apparatus according to claim 1, wherein said control means includes first and second control valves, said first control valve controlling said piston-displacing cylinders, and said second control valve controlling said valve-displacing cylinders one of said change-over valves being arranged to direct pressurized fluid to one side of each of said first and second control valves for displacing said first and second control valves in a first direction, the other of said change-over valves being arranged to direct pressurized fluid to the opposite side of each of said first and second control valves for displacing said first and second control valves in a second direction opposite said first direction.

5. A pumping apparatus according to claim 4 including flow regulating valves disposed in conduits leading to opposite sides of said first control valve for refracting the flow of fluid from said change-over valves to said first control valve to ensure that said valve-displacing cylinders displace their respective valves prior to the reversal of displacement of said pistons.

6. A pumping apparatus according to claim 1, wherein said pumping means comprises a first pumping means, a second pumping means being provided for supplying pressurized fluid to said change-over valves.

7. A pumping apparatus according to claim 6, wherein said second pumping means is connected to said piston-displacing cylinders for augmenting the actuating fluid supplied thereto by said first pumping means.

8. A pumping apparatus according to claim 7 including a pressure reducing valve disposed in a fluid conduit between said second pumping mean and said piston-displacing cylinders.

9. A pumping apparatus according to claim 1 including a manually actuable valve for reversing the direction of said actuating fluid independently of said control means.

10. A pumping apparatus according to claim 4 including pilot valves disposed between said first and second change-over valves and said first and second control valves and arranged to be acted upon by fluid from respective ones of said change-over valves for directing fluid to said control valves.

11. A pumping apparatus according to claim 10 including a flow regulating valve disposed between said first control valve and its respective pilot valve.

12. A pumping apparatus for delivering a flowable medium, comprising:

a double piston pump mechanism including:

a first piston, a first suction valve movable between open and closed positions and communicating a source of said flowable medium with said first piston when in its open position, a first pressure valve movable between open and closed positions and communicating said first piston with an outlet for said flowable medium when in its open position, a first fluid-actuated, piston-displacing cylinder for reciprocating said first piston between retracted and extended positions, such that said first piston draws-in flowable medium during displacement toward its retracted position and discharges the drawn-in flowable medium during displacement toward its extended position, a second piston, a second suction valve movable between open and closed positions communicating said source of said flowable medium with said second piston when in its open position, a second pressure valve movable between open and closed positions and communicating said second piston with said outlet when in its open position, a second fluid-actuated, piston-displacing cylinder for reciprocating said second piston between retracted and extended positions, such that said second piston draws-in flowable medium during displacement toward its retracted position and discharges the drawn-in flowable material during displacement toward its extended position, said second piston-displacing cylinder being operated 180 degrees out-of-phase relative to said first piston-displacing cylinder, fluid-actuated, valve-displacing cylinders for displacing said suction and pressure valves between their respective open and closed positions such that said first and second suction valves are operated 180 degrees out-of-phase, and said first and second pressure valves are operated 180 degrees out-of-phase, and first pumping means for supplying pressurized actuating fluid to said first and second piston-displacing cylinders and to said valve-displacing cylinders in either of two directions; and means for regulating the actuation of said first and second piston-displacing cylinders, including:

a first change-over valve mechanically connected to said first- piston-displacing cylinder for being actuated in response to said first piston-displacing cylinder reaching either of its fully extended and fully retracted positions, a second change-over valve mechanically connected to said second piston-displacing cylinder for being actuated in response to said second piston-displacing cylinder reaching either of its fully extended and fully retracted positions, control means operably connected to said first and second change-over valves for reversing the direction of actuating fluid to said first and second piston-displacing cylinders, and to said first and second suction valve-displacing cylinder, and to said first and second pressure valve-displacing cylinders, and second pumping means or supplying fluid to said first and second change-over valves, said first and second change-over valves being connected to said control means for directing fluid thereto from said second pumping means for actuating said control means.

13. A pumping apparatus according to claim 1, wherein each of said first and second change-over valves is provided with a catch device for releasably holding said first and second change-over valves in their respective positions of operation.

14. A pumping apparatus according to claim 4, wherein each of said first and second control valves is provided with a catch device for releasablyholding said first and second control valves in their respective positions of operation.

15. A pumping apparatus according to claim 11, wherein each of said pilot valves is provided with a catch device for releasably holding said pilot valves in their respective positions of operation.

* * * * *